US006227636B1

(12) United States Patent
Lye et al.

(10) Patent No.: US 6,227,636 B1
(45) Date of Patent: May 8, 2001

(54) REFRIGERATOR SHELF AND SERVING TRAY ASSEMBLY

(75) Inventors: Michael T. Lye, Warwick, RI (US); Angela R. Thalls, Arlington, MA (US); John P. Flannery, Smiths (BM); Nathan A. Dean, San Diego, CA (US); Peter Wooding; Jane K. Langmuir, both of Providence, RI (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/440,261

(22) Filed: Nov. 15, 1999

(51) Int. Cl.[7] ..... A47B 96/02
(52) U.S. Cl. ..... 312/408; 312/351
(58) Field of Search ..... 312/408, 410, 312/351; 108/108; 211/153, 175

(56) References Cited

U.S. PATENT DOCUMENTS

| | | | | |
|---|---|---|---|---|
| 2,015,389 | | 9/1935 | Whitted . | |
| 2,032,235 | | 2/1936 | Thomas . | |
| 2,078,681 | | 4/1937 | Otte . | |
| 2,205,781 | | 6/1940 | Vining . | |
| 4,138,504 | * | 2/1979 | Mack et al. . | |
| 4,386,703 | | 6/1983 | Thompson et al. . | |
| 5,297,486 | * | 3/1994 | Herrmann et al. | 108/108 |
| 5,507,398 | | 4/1996 | Miller . | |
| 5,558,419 | | 9/1996 | Dasher et al. . | |
| 5,735,589 | * | 4/1998 | Herrmann et al. | 211/153 X |

* cited by examiner

*Primary Examiner*—Janet M. Wilkens
(74) *Attorney, Agent, or Firm*—Everett G. Diederiks, Jr.

(57) ABSTRACT

A combination shelf and serving tray assembly includes a tray provided with a platform removably supported upon a frame mounted within a refrigerator cabinet. The platform can be removed from the cabinet and used as a serving tray. A lower end of the platform is provided with various spaced projections in the form of legs or nubs, preferably having elastomeric tips. The frame includes fore-to-aft extending rails having slots formed therein into which the legs are adapted to extend. The length of the slots and the spacing between the legs permit sliding of the tray between extended and retracted positions within the refrigerator cabinet.

13 Claims, 2 Drawing Sheets

REFRIGERATOR SHELF AND SERVING TRAY ASSEMBLY

BACKGROUND OF THE INVENTION

1. Field of the Invention

The present invention pertains to the art of refrigerators and, more particularly, to a combination shelf and serving tray assembly for use in a refrigerator.

2. Discussion of the Prior Art

A typical household refrigerator is provided with numerous vertically spaced shelves for use in supporting food items stored in the refrigerator. In the past, various proposals have also been made to enhance the versatility of refrigerator shelving arrangements. For example, proposals have been made to support shelves at various, selected heights within a refrigerator cabinet in order to accommodate different size food items. In order to enhance access to food items placed in a back portion of a shelf, it has also been proposed in the art to slidably mount refrigerator shelves for movement between extended and retracted positions. It has also been proposed to provide a refrigerator with a planar shelf member that can be selectively supported upon a frame within a compartment of the refrigerator so as to define a shelf, while also enabling the platform to be removed from the refrigerator and used as a tray.

It is known to combine many of these features into a single overall shelving arrangement. For example, U.S. Pat. No. 2,032,235 discloses a refrigerator incorporating a shelf platform which is adapted to be selectively removed from the cabinet of a refrigerator and used as a tray. More specifically, the tray is adapted to be supported upon a frame including a pair of spaced support members for sliding movement into and out of the refrigerator cabinet. In addition, the tray can be completely removed from the cabinet in order to carry away food products supported thereon.

Although certain advancements have been made in this art to increase the versatility of known refrigerator shelving arrangements, there still exists a need for an improved shelf and serving tray assembly for a refrigerator. More specifically, there exists a need in the art for an assembly which can be manufactured in an economical manner and incorporates a simple and efficient support arrangement for the tray whether used inside or outside of the refrigerator.

SUMMARY OF THE INVENTION

The present invention pertains to a combination shelf and serving tray assembly for use in a refrigerator including a shelving platform removably supported upon a frame mounted within a compartment of the refrigerator. More particularly, the platform is slidably mounted upon the frame for movement between extended and retracted positions relative to the refrigerator compartment and is designed to be completely removed from the compartment for use as a serving tray. In accordance with the most preferred embodiment of the invention, an underside of the tray is provided with various spaced projections in the form of legs that are preferably provided with elastomeric tips. The frame includes fore-to-aft extending and laterally spaced rails formed with respective elongated slots. When the platform is positioned within the refrigerator compartment, each of the legs extends into a respective one of the slots in order to guide the platform between the extended and retracted positions. The length of the slots and the spacing between the legs defines the extent to which the platform can be slid relative to the refrigerator compartment. When the platform is removed from the compartment and used as a serving tray, the legs support the tray through the elastomeric tips. The platform preferably includes an annular, upstanding peripheral edge which functions to advantageously contain any minor spills.

With this construction, the combination shelf and serving tray assembly of the invention represents a versatile arrangement for both storing food items in a refrigerator compartment and readily removing the food items simultaneously from the compartment. The legs of the shelving platform provide both support and guiding functions in a convenient and economical manner. In any event, additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
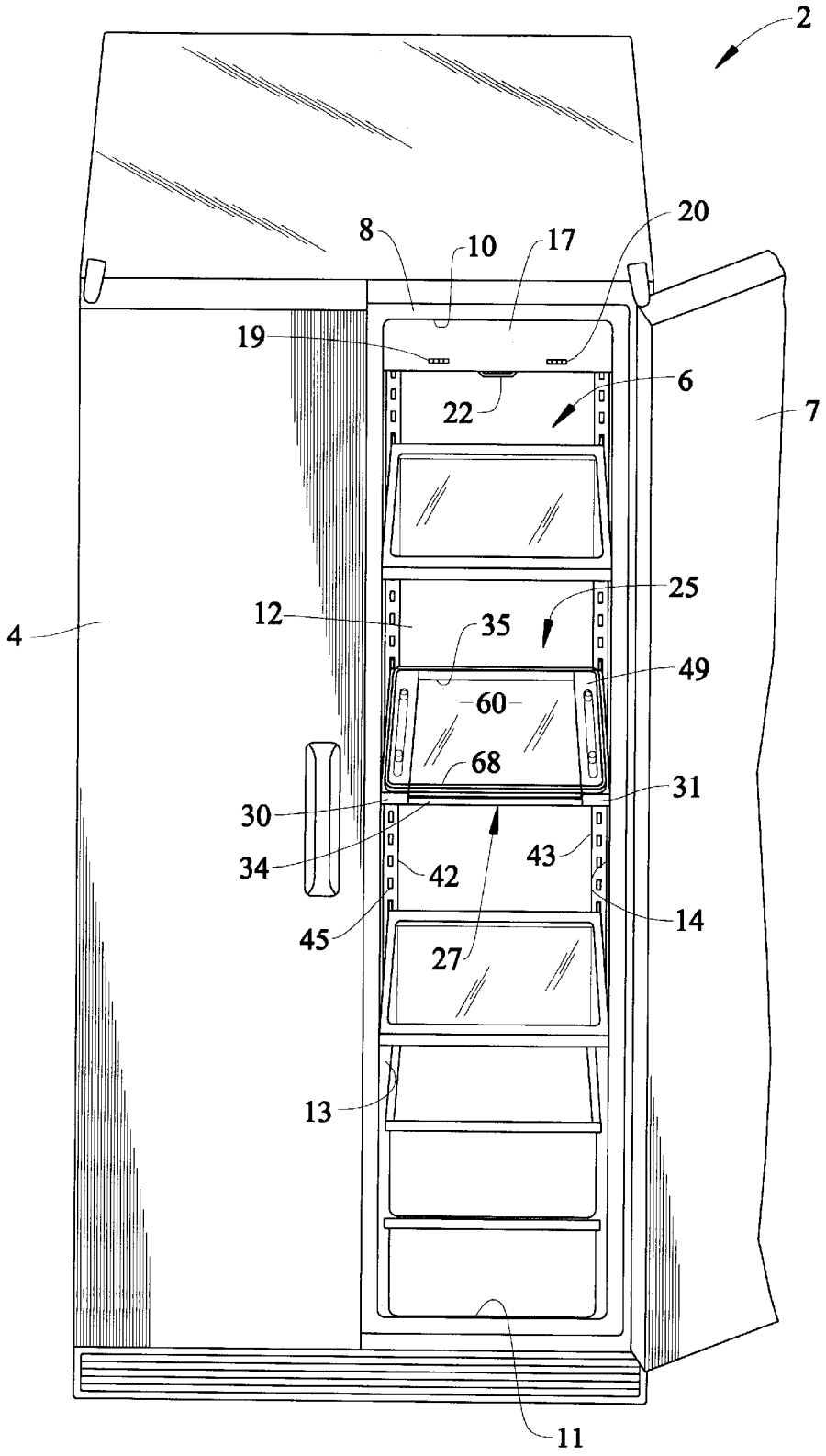
FIG. 1 is a generally upper perspective view of a side-by-side refrigerator cabinet incorporating the combination shelf and serving tray assembly of the present invention.

With initial reference to FIG. 1, a refrigerator cabinet incorporating a shelf and serving tray assembly constructed in accordance with the present invention is generally indicated at 2. As shown, refrigerator cabinet 2 includes a freezer compartment that is sealed by a door 4 and a fresh food compartment 6. Of course, fresh food compartment 6 would also be provided with a corresponding door which is partially shown at 7. In general, fresh food compartment 6 is defined by a liner 8 mounted within refrigerator cabinet 2, with liner 8 being formed by integrally molded top, bottom, rear and side walls 10–14 respectively. For the sake of completeness, FIG. 1 illustrates the mounting of an upper temperature control panel 17 that is provided with multiple dials 19 and 20 for use in manually regulating the temperature maintained in both of the compartments of refrigerator cabinet 2. In addition, control panel 17 has associated therewith a light housing 22 for illuminating fresh food compartment 6 when the compartment is accessed. The present invention particularly pertains to the versatile and shelf and serving tray assembly 25 that is shown mounted within fresh food compartment 6 for exemplary purposes. Therefore, although assembly 25 of the present invention is shown for use in a side-by-side refrigerator cabinet 2, it should be readily understood that assembly 25 could be utilized in various other types of cabinets, including top mount style refrigerators, without departing from the spirit of the invention.

In general, shelf and serving tray assembly 25 of the invention includes a shelf support frame 27 incorporating a pair of laterally spaced and fore-to-aft extending support rails 30 and 31 which are interconnected by front and rear cross braces 34 and 35. For purposes of the invention, shelf support frame 27 can be mounted within fresh food compartment 6 in various ways. As shown, support rails 30 and 31 are provided with rearwardly projecting connectors 38 and 39 which are adapted to be attached to respective brackets 42 and 43 mounted to rear wall 12 of compartment 6. In this manner, shelf support frame 27 can be vertically adjusted within fresh food compartment 6. More specifically, brackets 42 and 43 are formed with various vertically spaced mounting slots 45 for use in selectively positioning shelf support frame 27 at a desired height within fresh food compartment 6. The particular mounting of shelf support frame 27 is not considered part of the present invention and is merely presented herein for the sake of completeness.

Once shelf support frame 27 is mounted within fresh food compartment 6, an upper surface 49 of each of support rails 30 and 31 generally extends in a horizontal plane. Furthermore, as clearly shown in these figures, the upper surface 49 of each support rail 30, 31 is provided with at least one vertically extending opening 52. More specifically, in accordance with the most preferred embodiment of the invention shown herein, opening 52 provided in the upper surface 49 of each support rail 30, 31 takes the form of an elongated slot that extends from adjacent a front end portion 55 to short of a rear end portion 56 of a respective one of the support rails 30, 31.

The shelf and serving tray assembly 25 of the present invention also includes a tray which is generally indicated at 60. As will be detailed more fully below, tray 60 can be selectively supported upon shelf support frame 27 or can be completely removed from fresh food compartment 6. Tray 60 generally includes a platform 63 having a substantially planar upper support surface 65. Upper surface 65 of platform 63 leads to an annular, upstanding peripheral rim 68. The presence of rim 68 advantageously minimizes the potential of any substance spilled upon upper surface 65 from falling off of platform 63. As also shown, tray 60 preferably includes a plurality of leg members 71–74 which project from a lower surface 76 of platform 63. In the most preferred form of the invention, leg members 71–74 terminate in elastomeric tips as indicated at 78.

Although various materials can be utilized to form shelf support frame 27 and tray 60 without departing from the present invention, shelf support frame 27 is preferably made of metal, such as aluminum, and tray 60 is preferably formed of a transparent material such as acrylic. With this arrangement, leg members 71–74 are integrally formed with platform 63 in order to enhance the overall structurally integrity of tray 60. When utilized outside of fresh food compartment 6, tray 60 can be supported with elastomeric tips 78 engaging a planar surface. If tray 60 is utilized to support food items which need to be refrigerated, tray 60 can be readily positioned above shelf support frame 27 within fresh food compartment 6 and lowered such that leg members 71–74 extend into respective elongated openings 52. In this position, lower surface 76 of platform 63 will rest upon the upper surface 49 of each support rail 30, 31. In the most preferred form of the invention, the distance between leg members 71 and 72, as well as the distance between leg members 73 and 74, is smaller than the length of each opening 52 as clearly indicated in FIG. 1. With this configuration, tray 60 is permitted to slide, to a limited extent, between fore and aft positions within fresh food compartment 6. This ability of tray 60 to be shifted relative to shelf support frame 27 and fresh food compartment 6 can advantageously enhance the ability of a user to access food items supported upon a rear portion of platform 63. In addition, removal of tray 60 is enhanced when tray 60 is repositioned such that a front portion thereof projects forward of shelf support frame 27.

Figure 2:
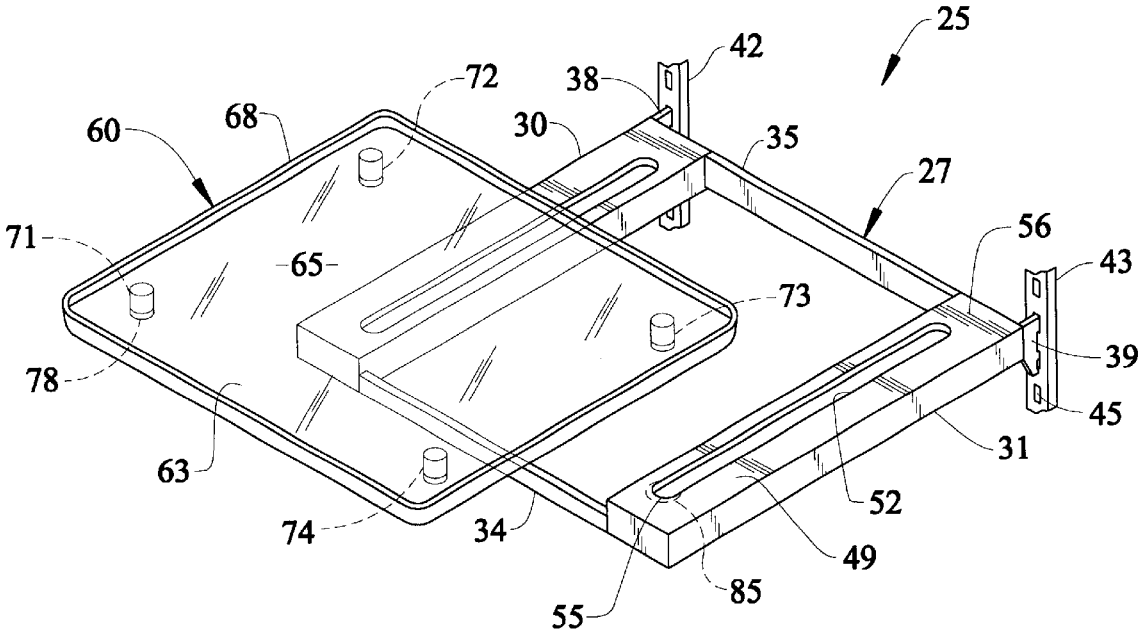
FIG. 2 is an enlarged, exploded perspective view of the shelf and serving tray assembly of FIG. 1.
Figure 3:
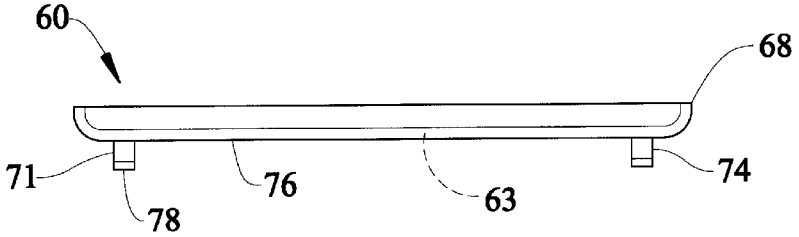
FIG. 3 is a front elevational view of a platform or tray incorporated in the overall assembly of the invention.

Based on the above, it should be readily apparent that the combination shelf and serving tray assembly of the present invention can be economically manufactured and represents a versatile arrangement that can be used by a consumer to conveniently store items within a refrigerator and to serve those items. However, although the present invention has been described with respect to a preferred embodiment, it should be readily understood that various changes and/or modifications can be made to the invention without departing from the spirit thereof. For instance, although the upper surface 49 of each support rail 30, 31 is shown to include an opening 52 in the form of a single elongated slot, it should be recognized that multiple, smaller length slots could also be utilized to perform the same function. In addition, support rails 30 and 31 could be shorter such that a front end of tray 60 extends beyond the rails. In order to prevent tray 60 from flipping due to an abundance of items being placed on the front end of tray 60, the forward most ends of each opening 52 could be provided with a keyhole 85 such as that indicated in dotted lines in rail member 30 in FIG. 2. Here, rear leg members 72 and 73 would be diametrically increased while being formed with a reduced diametric portion adjacent support surface 65. In this manner, the leg members 72 and 73 can only be placed in or removed from openings 52 at the keyholes 85. It should be noted that tray 60 is preferably constructed symmetrical such that platform 63 can be positioned upon shelf support frame 27 in various configurations, including a reversal of tray 60 from that shown in FIG. 2. In fact, tray 60 can be made square, such that any one of the sides of tray 60 can be exposed at the front of fresh food compartment 6 at any given time. As an additional modification, it should be noted that leg members 71–74 could take various forms including simply providing rubber nubs. In addition, elongated runners could be provided to define the various leg members. Handles could also be incorporated as part of tray 60. Finally, although shelf support frame 27 is illustrated to be an integrated unit for mounting within fresh food compartment 6, support rails 30 and 31 of frame 27 need not be interconnected, but rather separate support rails could be individually supported within fresh food compartment 6 in various ways known in the art. In any event, the above description is not intended to be limiting to the invention, but rather illustrative. Therefore, the invention is only intended to be limited by the scope of the following claims.

We claim:

1. In a refrigerator including a food storage compartment having an open frontal portion adapted to be selectively closed by a door, a combination shelf and serving tray assembly comprising:

a shelf support frame mounted in the compartment in a substantially horizontal plane, said support frame being formed with a pair of laterally spaced, fore-to-aft extending slots; and a tray including a platform for carrying food items, said platform having a substantially planar upper surface portion and a plurality of spaced projections extending from a lower surface and adjacent respective fore-to-aft end portions of the platform, said platform being selectively useable as a shelf within the compartment and as a serving tray outside of the refrigerator wherein, within the compartment, said platform is positioned on the support frame with the projections extending into a respective said slot to enable the platform to slide relative to the support frame, and wherein said platform can be removed from upon the support frame, without removal of the support frame from the compartment, for use as a serving tray which can be stabilized on a support surface, outside the refrigerator, upon the projections.

2. The combination shelf and serving tray assembly according to claim 1, wherein said projections are defined by at least four spaced leg members extending from the platform, at least two of said leg members being adapted to extend in a respective said slot.

3. The combination shelf and serving tray assembly according to claim 2, wherein the leg members are arranged as pairs, with each pair being received in a respective said slot.

4. The combination shelf and serving tray assembly according to claim 2, wherein said leg members limit both the forward and rearward movement of the platform relative to the support frame.

5. The combination shelf and serving tray assembly according to claim 4, wherein said support frame includes a pair of spaced rails, with each rail being provided with one of said slots.

6. The combination shelf and serving tray assembly according to claim 2, wherein each of said leg members includes an elastomeric tip.

7. The combination shelf and serving tray assembly according to claim 1, wherein said platform terminates in an annular, upstanding peripheral rim.

8. In a refrigerator including a food storage compartment having an open frontal portion adapted to be selectively closed by a door, a combination shelf and serving tray assembly comprising:

a shelf support frame mounted in the compartment in a substantially horizontal plane, said support frame being formed with a plurality of vertical, spaced openings; and a tray including a platform for carrying food items, said platform including a substantially planar upper support surface portion and at least two spaced leg members projecting from a lower surface of the platform, with each of said leg members including an elastomeric tip, said tray being usable as a shelf within the compartment wherein each of the leg members extends into a respective one of the vertical openings of the support frame, and as a serving tray wherein the platform is taken off the support frame and removed from the compartment.

9. The combination shelf and serving tray assembly according to claim 8, wherein each of the vertical openings is elongated in a fore-to-aft direction within the compartment so as to define slots, wherein said leg members guide said platform for sliding movement upon the support frame.

10. The combination shelf and serving tray assembly according to claim 9, wherein at least four spaced leg members extend from the platform, said leg members being arranged as pairs, with each pair being received in a respective said slot.

11. The combination shelf and serving tray assembly according to claim 9, wherein said leg members limit both the forward and rearward movement of the platform relative to the support frame.

12. The combination shelf and serving tray assembly according to claim 11, wherein said support frame includes a pair of spaced rails, with each rail being provided with one of said slots.

13. The combination shelf and serving tray assembly according to claim 8, wherein said platform terminates in an annular, upstanding peripheral rim.

* * * * *